US006149078A

United States Patent [19]

Tsai et al.

[11] Patent Number: 6,149,078

[45] Date of Patent: Nov. 21, 2000

[54] SLURRY NOZZLE

[75] Inventors: Dong-tay Tsai, Kaohsiung; Hua-jen Tseng, Chu-Pei; Chun-chieh Lee, Pao-Shan Village; Yi-hua Chin, Taipei, all of Taiwan

[73] Assignee: Mosel Vitelic, Inc., Hsinchu, Taiwan

[21] Appl. No.: 09/455,359

[22] Filed: Dec. 6, 1999

[30] Foreign Application Priority Data

Aug. 3, 1999 [TW] Taiwan ..... 88113340

[51] Int. Cl.[7] ..... B05B 1/26

[52] U.S. Cl. ..... 239/499; 239/520

[58] Field of Search ..... 239/104, 499, 239/518, 520

[56] References Cited

U.S. PATENT DOCUMENTS 4,912,782 4/1990 Robbins ..... 239/520

5,830,334 11/1998 Kobayashi ..... 239/104

6,036,118 3/2000 Walker et al. ..... 239/518

*Primary Examiner*—Andres Kashnikow

*Assistant Examiner*—Davis Hwu

*Attorney, Agent, or Firm*—Bacon & Thomas, PLLC

[57] ABSTRACT

A slurry nozzle for supplying slurry in chemical mechanical polishing (CMP) including at least one slurry line, a slurry nozzle enclosure for accommodating the slurry line, and a baffle ring mounted at one end of the slurry nozzle enclosure. A plurality of apertures is formed on the sidewall of the slurry line for the slurry to spray out. The slurry spraying out from the slurry line flows down along the inner sidewall of the slurry baffle ring after the slurry impinges onto the slurry baffle ring.

2 Claims, 4 Drawing Sheets

SLURRY NOZZLE

FIELD OF THE INVENTION

The present invention relates to a slurry nozzle and in particular, to a slurry nozzle used in chemical mechanical polishing (CMP).

BACKGROUND OF THE INVENTION

Chemical mechanical polishing (CMP) is currently a new planarization technology employed in the manufacturing process of large scale integrated circuits as well as very large scale integrated circuits. In a CMP process, slurry is used as a medium and a wafer is pressed against a polishing pad so that the surface of the wafer is polished by the method of rotational polish on the polishing pad. The parameters that affect the CMP process are: the composition of the slurry, the polishing pressure on the wafer, the wafer rotating speed during polishing, the material of the polishing pad, the size distribution of the abrasive in the slurry, the feed rate of slurry, and the working temperature, etc. Among these parameters, the polishing pressure on the wafer is the subject matter of the following description.

Referring to FIG. 1, a conventional CMP apparatus includes: a wafer 11 to be treated; a polishing pad 12; a distribution pad 13; a carrier head 14 for gripping the wafer 11; a carrier quick connector 15 for quickly connecting/disconnecting the carrier head 14 and the components (not shown) that drive the carrier head 14; a protection rubber 16 for protecting the above-mentioned components from being directly splashed by the slurry; and a slurry nozzle 17 for supplying the slurry required in CMP.

Referring to FIG. 2, the slurry nozzle 17 includes six slurry lines 171 and a slurry nozzle enclosure 172 for enclosing the six slurry lines 171 so as to provide six different types of slurry used in various conditions.

Referring to FIG. 3, the CMP apparatus is provided with five carrier heads 14 that deal with five wafers at one time. The slurry nozzle 17 is above the center of the polishing pad 12 and the five carrier heads 14 are arranged in a radial pattern from the center of the polishing pad 12. After the slurry is dispersed downward from the slurry nozzle 17 (in a direction perpendicular to the figure), it falls into the distribution pad 13. The distribution pad 13 is mounted onto the polishing pad 12 and is rotated simultaneously with it (the rotation direction is noted by an arrow) to distribute the slurry to the region around the polishing pad 12. The carrier head 14 is used to grip and rotate the wafer 11 in a direction shown by the arrow. By means of the rotation of wafer 11 and the polishing pad 12, together with the slurry, the wafer 11 is thus polished.

Some drawbacks of the above-mentioned CMP apparatus will be described in the following.

In a normal situation, the slurry flows in a specific flow rate so as to facilitate the planarization process. In order to provide a larger flow rate, the flow speed and the pressure of the slurry in the slurry lines 171 have to be increased. Thus, in the polishing process, the slurry impinges onto the distribution pad 13 with a large speed and this causes the slurry to splash and adhere onto the carrier head 14, the carrier quick connector 15, and the protection rubber 16 (referring to the arrow as shown in FIG. 1). After the slurry dries, the dried slurry can strip and fall onto the polishing pad 12. If this occurs in the polishing process, the wafer 11 can be easily damaged.

In addition, if too much slurry is adhered to the carrier head 14, the carrier quick connector 15, and the protection rubber 16, the polishing pressure exerted to the wafer increases, and affects both the uniformity and the removing rate of the wafer.

Furthermore, the splashed slurry adhered to the carrier head 14 becomes a waste of material. Besides, the dried slurry adhered to the carrier head 14, the carrier quick connector 15, and the protection rubber 16 causes a difficulty to maintain the apparatus.

SUMMARY OF THE INVENTION

It is therefore an object of the present invention to provide a slurry nozzle for use in chemical mechanical polishing, which avoids splashing the slurry to the adjacent parts under a specific flow rate of slurry, reduces damages to the wafer, and also avoids the wastage of slurry.

In accordance with the first aspect of the present invention, a slurry nozzle is provided to supply slurry for use in chemical mechanical polishing (CMP). The slurry nozzle includes at least one slurry line, a slurry nozzle enclosure for accommodating the slurry line, and a baffle ring mounted at one end of the slurry nozzle enclosure. A plurality of apertures are formed on the sidewall of the slurry line for spraying out the slurry. The slurry spraying out from the slurry line flows down along the inner sidewall of the slurry baffle ring after the slurry impinges onto the slurry baffle ring.

Another object of the present invention is to provide a slurry nozzle, wherein a slurry nozzle enclosure and a slurry baffle ring are integrally formed.

DETAILED DESCRIPTION OF THE PREFERRED EMBODIMENT

Figure 4:
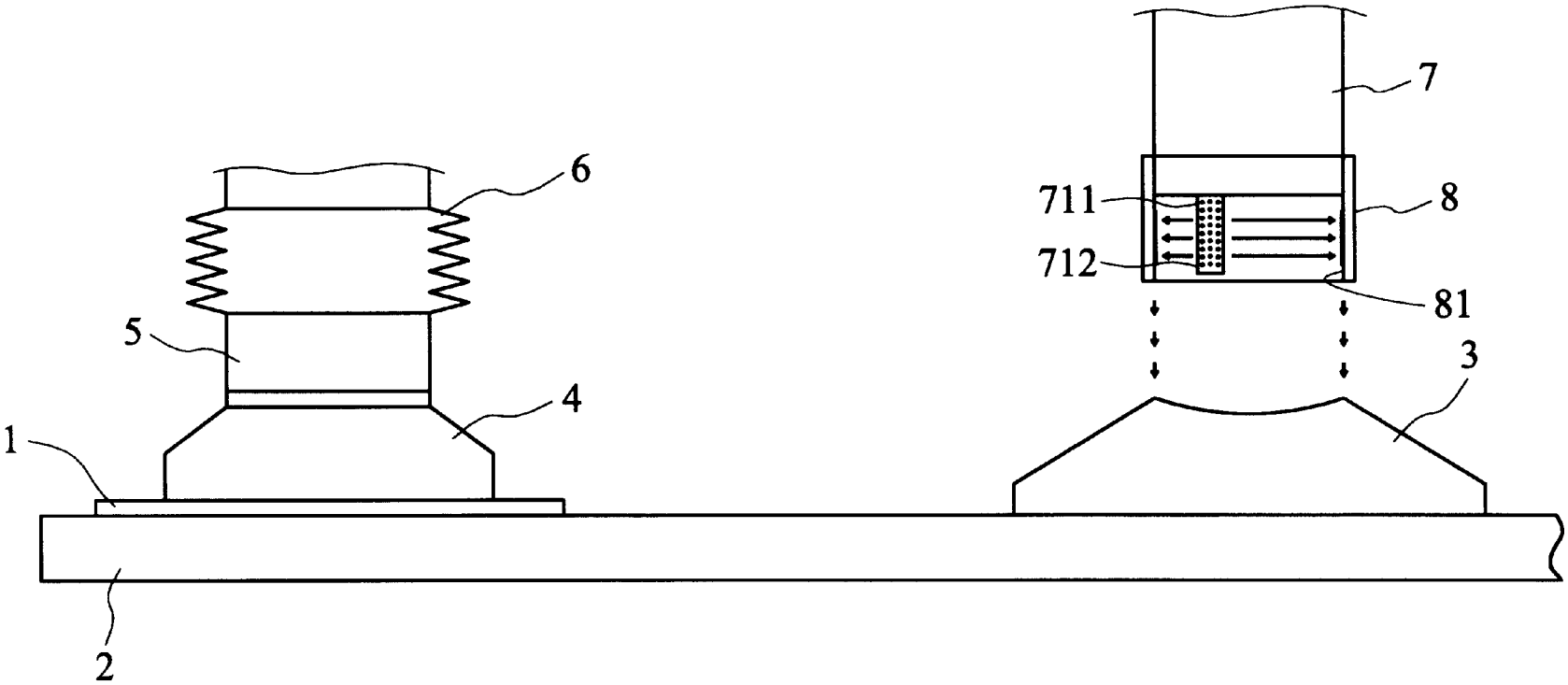
FIG. 4 is a partial schematic view of a CMP apparatus in accordance with a preferred embodiment of the present invention.

Referring to FIG. 4, a CMP apparatus in accordance with the embodiment of the present invention includes: a wafer 1 to be treated; a polishing pad 2; a distribution pad 3; a carrier head 4 for gripping the wafer 1; a carrier quick connector 5 for quickly connecting/disconnecting the carrier head 4 and the components (not shown) which drive the carrier head 4; a protection rubber 6 for protecting the above-mentioned components from being directly splashed with the slurry; and a slurry nozzle 7 for supplying the slurry required in CMP.

Figure 1:
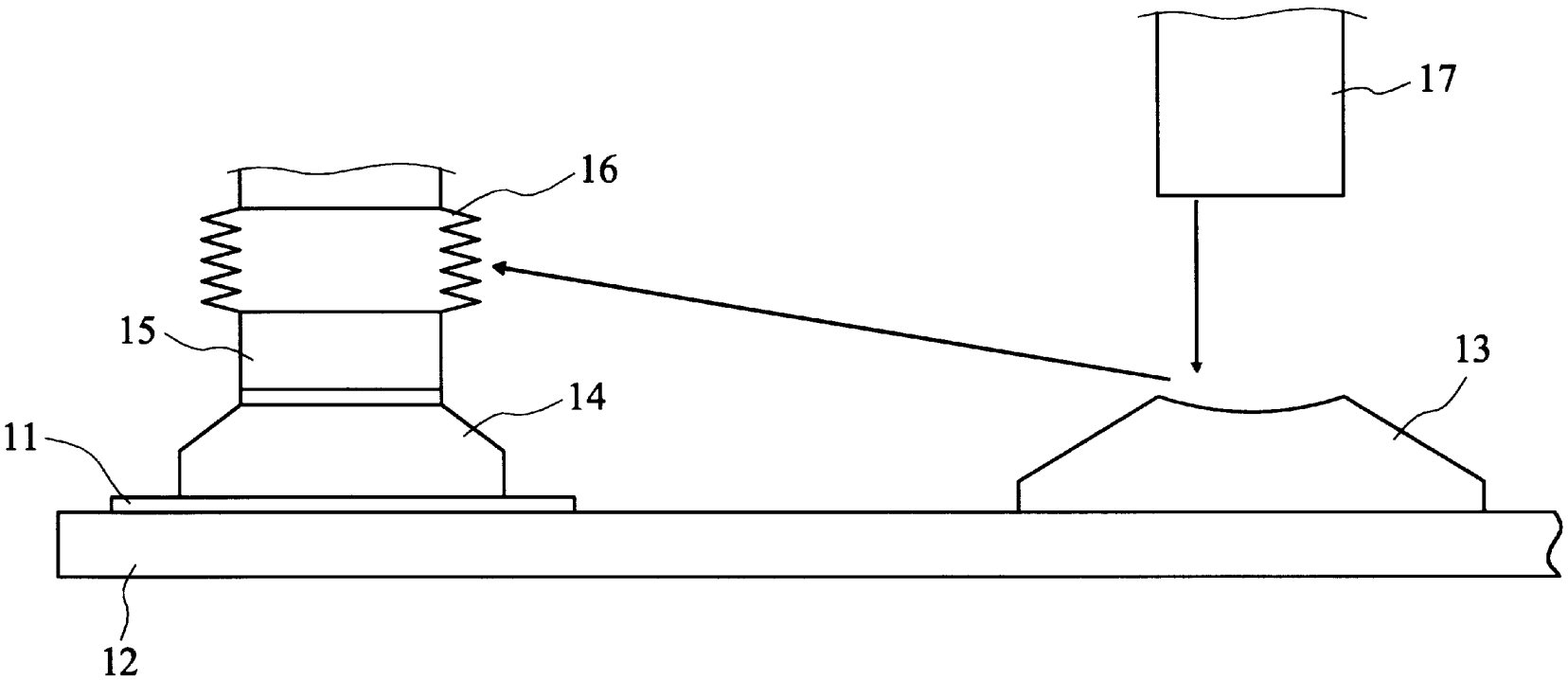
FIG. 1 (PRIOR ART)
FIG. 1 is a partial schematic view showing a conventional CMP apparatus.
Figure 2:
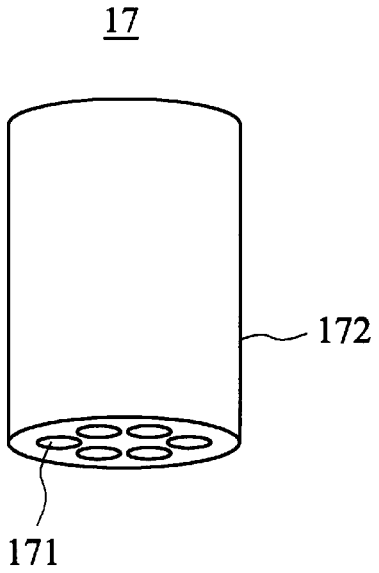
FIG. 2 (PRIOR ART)
FIG. 2 is a pictorial view showing a conventional slurry nozzle.
Figure 3:
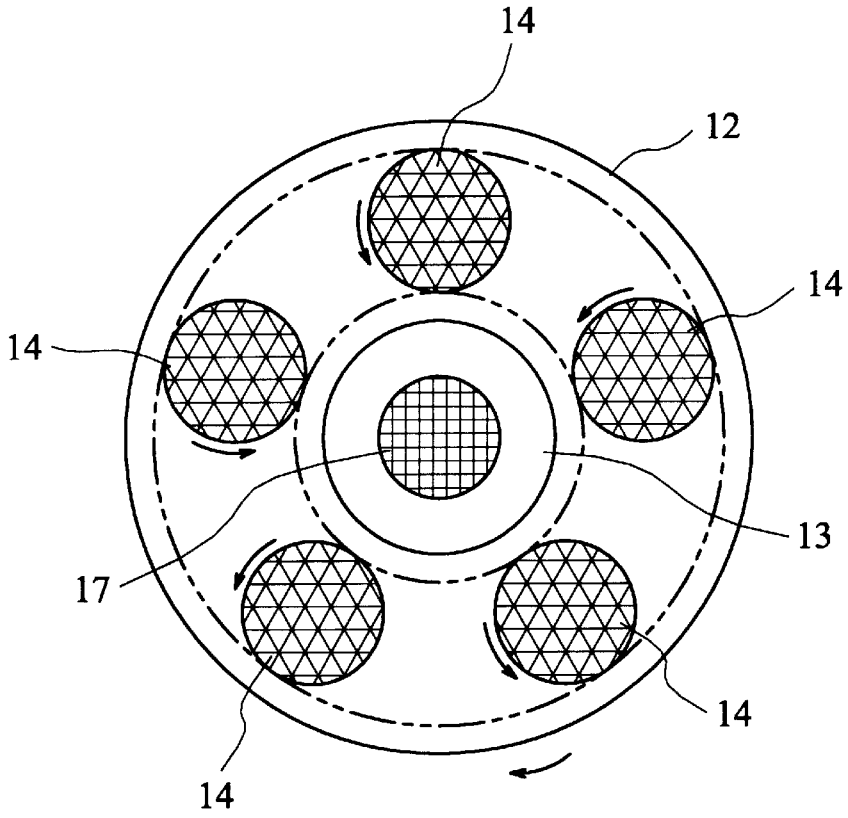
FIG. 3 (PRIOR ART)
FIG. 3 is a schematic plan view of the conventional CMP apparatus as shown in FIG. 1.

By comparing FIGS. 4 and 1, it can be known that the embodiment of the invention is characterized in that the construction of the slurry nozzle 7 in accordance with the embodiment is different from that of the conventional slurry nozzle 17. The wafer 1, polishing pad 2, distribution pad 3, carrier head 4, carrier quick connector 5, and protection rubber 6 are, in construction, similar to the wafer 11, polishing pad 12, distribution pad 13, carrier head 14, carrier quick connector 15, and protection rubber 16 respectively. Therefore, a detailed description of these elements is omitted.

Figure 5:
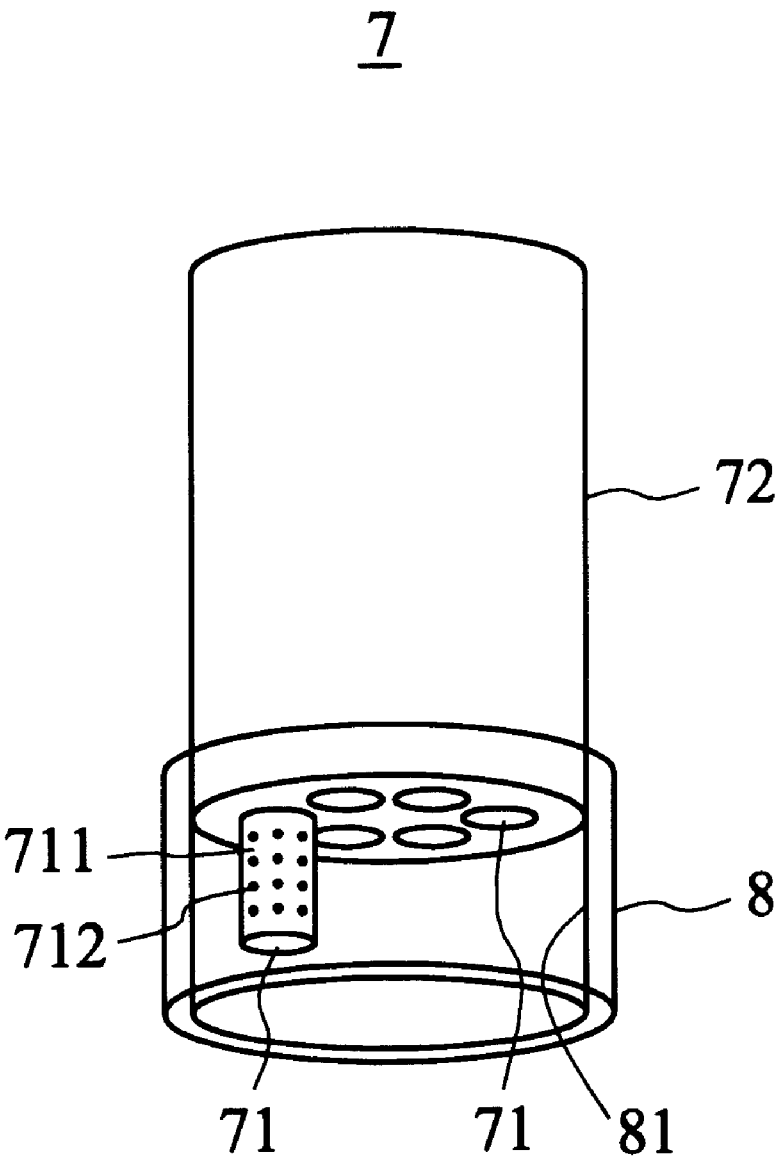
FIG. 5 is a pictorial view of a slurry nozzle in accordance with the preferred embodiment of the present invention.

Referring to FIG. 5, the slurry nozzle 7 includes: a slurry nozzle enclosure 72; six slurry lines 71 located within the slurry nozzle enclosure 72, wherein one of the slurry lines 71 extends beyond the bottom surface of the slurry nozzle enclosure 72 and the slurry line 71 being provided with a plurality of apertures 712 in the sidewall 711 of the slurry line 71 for supplying the slurry required in CMP; a slurry baffle ring 8 having an inner sidewall 81 to block the splashed slurry and guide the slurry to flow down along the inner sidewall 81 of the slurry baffle ring 8.

It should be noted that the slurry baffle ring 8 is made of a transparent material so that the slurry line 71 is visible from the outside, as shown in FIG. 5. The slurry flows into the distribution pad 3 and the CMP is carried out in accordance with the conventional method described above.

The purpose of providing the plurality of apertures 712 on the slurry line 71 is to allow the slurry spraying from the apertures 712 to impinge on the inner sidewall 81 of the slurry baffle ring 8. A plurality of apertures 712 are provided on the slurry line 71 so that the total area of the apertures 712 is equal to the cross section area of the slurry line 71. In this case, the slurry flowing along the slurry line 71 is ejected from these apertures 712. Then, the slurry impinges on the inner sidewall 81 of the slurry baffle ring 8 and flows down.

It should be understood by those skilled in the art that the larger cross section area through which the fluid flows is, the smaller the flow speed of the slurry is under a specific flow rate of the fluid. The smaller the flow speed of the fluid is, the smaller the momentum is, and as a result, the smaller the impinging force of the fluid is. The point of the present invention is that in the situation where a specific flow rate is required, changing the structure of the slurry nozzle will reduce the force impinging the distribution pad 3, and the slurry splashing to the peripheral parts can be avoided.

As a result, referring again to FIG. 4, after the slurry from the slurry line 71 impinges the slurry baffle ring 8, the most momentum of the slurry is absorbed by the slurry baffle ring 8, which causes the slurry to change direction. Moreover, the cross section area of the slurry baffle ring 8 is larger than that of the slurry line 71, the speed of the slurry flowing down from the slurry baffle ring 8 becomes smaller. The force of the downward slurry impinging onto the distribution pad 3 becomes smaller so that the slurry does not splash to the carrier head 4, the carrier quick connector 5, and the protection rubber 6. Thus, the slurry nozzle 7 of the present invention prevents the stripping of dried slurry which can cause damage of the wafer 1, and also avoids ununiform polishing pressure and wastage of slurry.

The size of each of the apertures 712 of the slurry line 71 is smaller than the cross section area of the slurry line 71 and the apertures 712 can be blocked by the slurry. However, the normal operation can be carried out on condition that the apertures 712 are cleaned by regular maintenance.

While the invention has been described by way of example and in terms of a preferred embodiment, it is to be understood that the invention is not limited to the disclosed embodiment. To the contrary, it is intended to cover various modifications. Therefore, the scope of the appended claims should be accorded the broadest interpretation so as to encompass all such modifications. For example, all the slurry lines 71 can extend beyond the bottom surface of the slurry nozzle enclosure 72 and are provided with a plurality of apertures 712 each. At this moment, the slurry ejecting from one slurry line 71 is partially blocked by the adjacent slurry line 71 and drops down. In addition, if the slurry baffle ring 8 and the slurry nozzle 7 are integrally formed, the same function can still be obtained.

What is claimed is:

1. A slurry nozzle for supplying slurry in chemical mechanical polishing (CMP), comprising:

at least one slurry line having a sidewall for the slurry to spray out;

a slurry nozzle enclosure for accommodating said at least one slurry line; and a baffle ring mounted at one end of the slurry nozzle enclosure from which the slurry flows out, having an inner sidewall enclosing the slurry line, wherein said at least one slurry line is provided with a plurality of apertures formed on said sidewall of said at least one slurry line for the slurry to spray; and the slurry spraying out from said slurry line flows down along said inner sidewall of said slurry baffle ring after the slurry impinges onto said slurry baffle ring.

2. A slurry nozzle according to claim 1, wherein said slurry nozzle and said slurry baffle ring are integrally formed.

* * * * *